US009944480B2

(12) United States Patent
Hirano et al.

(10) Patent No.: US 9,944,480 B2
(45) Date of Patent: Apr. 17, 2018

(54) IMAGE FORMING APPARATUS AND FEEDING DEVICE

(71) Applicant: CANON KABUSHIKI KAISHA, Tokyo (JP)

(72) Inventors: Yuya Hirano, Odawara (JP); Fumiaki Mizuno, Suntou-gun (JP); Yuta Hojo, Suntou-gun (JP); Atsushi Kawarago, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/453,647

(22) Filed: Mar. 8, 2017

(65) Prior Publication Data

US 2017/0267475 A1 Sep. 21, 2017

(30) Foreign Application Priority Data

Mar. 18, 2016 (JP) ..... 2016-055761

(51) Int. Cl.
*B65H 3/06* (2006.01)
*B65H 7/12* (2006.01)
(Continued)

(52) U.S. Cl.
CPC ..... *B65H 7/12* (2013.01); *B65H 3/02* (2013.01); *B65H 3/06* (2013.01); *B65H 3/46* (2013.01); *B65H 3/52* (2013.01); *B65H 7/06* (2013.01); *B65H 7/125* (2013.01); *B65H 7/20* (2013.01); *B65H 2801/06* (2013.01)

(58) Field of Classification Search
CPC ... B65H 3/02; B65H 3/06; B65H 3/46; B65H 3/52; B65H 7/06; B65H 7/12; B65H 7/125; B65H 7/20
See application file for complete search history.

(56) References Cited

U.S. PATENT DOCUMENTS

2010/0102499 A1* 4/2010 Takamori ..... B65H 3/0684 271/10.13
2014/0232055 A1* 8/2014 Yamagata ..... B65H 7/02 271/3.18
2016/0289014 A1* 10/2016 Aizono ..... G03G 15/6508

FOREIGN PATENT DOCUMENTS

JP 200669703 A 3/2006
JP 2008050114 A 3/2008
(Continued)

*Primary Examiner* — David H Bollinger
(74) *Attorney, Agent, or Firm* — Canon U.S.A., Inc. IP Division

(57) ABSTRACT

An image forming apparatus includes an accommodation unit, feeding, conveying, and separating members, and detecting, control, image forming, and regulating units. The conveying member conveys a fed recording material. The separating member forms a nip and separates recording materials. The detecting unit detects that the recording material has been fed to the nip. The feeding member starts feeding an accommodated recording material and, where a recording material is fed to the nip, causes the feeding to be finished. An image is formed on a fed recording material. The regulating unit regulates an end on an upstream side. The control unit measures a period from a recording material feeding to detection that a recording material is fed to the nip. Based on the measured period, information is output indicating that a position of the regulating unit is deviated from a position according to a size of the accommodated recording materials.

15 Claims, 11 Drawing Sheets

(51) Int. Cl.

| | |
|---|---|
| ***B65H 3/52*** | (2006.01) |
| ***B65H 3/02*** | (2006.01) |
| ***B65H 3/46*** | (2006.01) |
| ***B65H 7/20*** | (2006.01) |
| ***B65H 7/06*** | (2006.01) |

(56) References Cited

FOREIGN PATENT DOCUMENTS

| | | | |
|---|---|---|---|
| JP | 201458400 | A | 4/2014 |
| JP | 2015105175 | A | 6/2015 |
| WO | 2011007406 | A1 | 1/2011 |

* cited by examiner

IMAGE FORMING APPARATUS AND FEEDING DEVICE

BACKGROUND OF THE INVENTION

Field of the Invention

The disclosure relates to an image forming apparatus such as a copier and a printer and a feeding device used in the apparatus and executing a feed control over a recording material therein.

Description of the Related Art

Conventionally, an image forming apparatus such as a copier and a printer has a cassette configured to accommodate recording materials. The cassette has a regulating plate. The regulating plate may be positionally moved in accordance with the size of recording materials to regulate a movement of the recording materials accommodated in the cassette.

According to Japanese Patent Laid-Open No. 2015-105175, a time period from start of feeding of a recording material to detection of the recording material by a registration sensor is measured so that whether the position of a rear-end regulating plate is deviated from a proper position (or position depending on the size) or not based on the measured time period. The rear-end regulating plate here is a regulating plate configured to regulate rear ends (upstream ends in a feeding direction) of recording materials. If it is detected that the position of the rear-end regulating plate is deviated, a user may be prompted to check the cassette, which can reduce the possibility that a conveyance failure due to a delay of feeding of a recording material will occur in future. In a case where a conveyance failure actually occurs, a cause of the failure may be notified to a user so that the same type of conveyance failure can be prevented for improved usability.

On the other hand, it is known that an influence of friction with a previously fed recording material may result in varied positions of leading ends (downstream ends in the feeding direction) of recording materials accommodated in the cassette. According to International Publication No. WO2011/007406, in order to make leading ends of recording materials to be uniform, a control is executed in which a subsequent recording material is fed in advance until the leading end of the subsequent recording material reaches a separation nip formed by a feed roller and a retard roller. Performing such an operation for making positions of leading ends of recording materials uniform can reduce varied positions of the leading ends of the recording materials.

According to Japanese Patent Laid-Open No. 2015-105175, a longer time period may be required from start of feeding of a recording material to detection of the recording material by a registration sensor in a state that the position of the rear-end regulating plate is deviated, compared with a state that the position of the rear-end regulating plate is not deviated. However, execution of the control according to International Publication No. WO2011/007406 can adjust the position of the leading end of a subsequent recording material to match with the separation nip. Thus, even in a state that the position of the rear-end regulating plate is deviated, the measured time period is substantially equal to the measured time period in a state that the position of the rear-end regulating plate is not deviated. In other words, it is difficult to detect a deviation of the rear-end regulating plate.

SUMMARY OF THE INVENTION

Aspects of the disclosure provide an image forming apparatus and a feeding device which can reduce variations in positions of leading ends of recording materials accommodated in an accommodation unit and which at the same time can detect a deviation of a rear-end regulating plate provided in the accommodation unit.

According to an aspect of the disclosure, an image forming apparatus includes an accommodation unit configured to accommodate a recording material, a feeding member configured to feed a recording material accommodated in the accommodation unit, a conveying member configured to convey a recording material fed by the feeding member, a separating member configured to form a nip with the conveying member and separate a plurality of recording materials at the nip, a detecting unit configured to detect that the plurality of recording materials has been fed to the nip, a control unit which causes the feeding member to start feeding of a recording material accommodated in the accommodation unit and, in a case where the detecting unit detects that a plurality of recording materials is fed to the nip, causes the feeding member to finish the feeding, an image forming unit configured to form an image on a recording material fed from the accommodation unit, and a regulating unit configured to regulate an end on an upstream side in a feeding direction of recording materials accommodated in the accommodation unit, wherein the control unit measures a time period from start of feeding of a recording material performed by the feeding member to detection by the detecting unit of that a plurality of recording materials is fed to the nip and, based on the measured time period, outputs information indicating that a position of the regulating unit is deviated from a position according to a size of the recording materials accommodated in the accommodation unit.

Further features of the disclosure will become apparent from the following description of embodiments with reference to the attached drawings.

DESCRIPTION OF THE EMBODIMENTS

First Embodiment

Description of Configuration of Image Forming Apparatus

Figure 1:
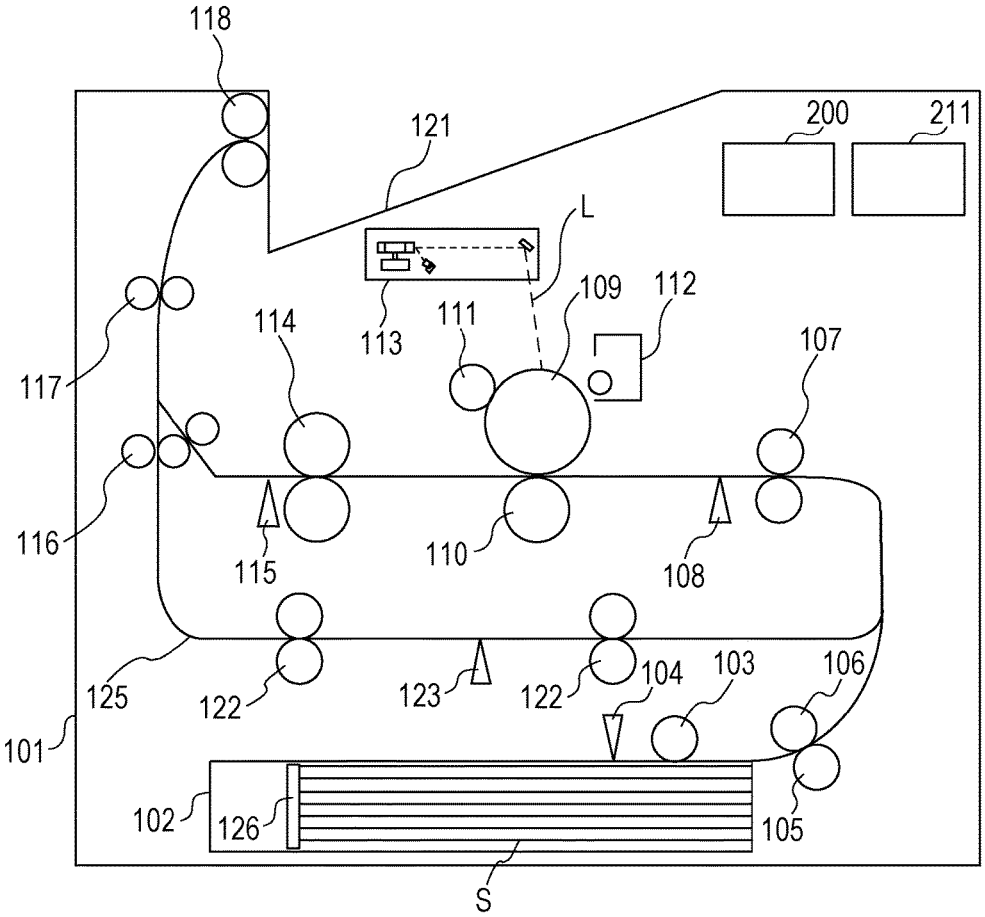
FIG. 1 is a schematic configuration diagram illustrating an image forming apparatus.

According to a first embodiment, an electrophotographic laser beam printer 101 (hereinafter, called a printer 101) is applied as an image forming apparatus. FIG. 1 is a schematic configuration diagram of the printer 101.

A cassette 102 is an accommodation unit configured to accommodate sheets S (recording materials) and may be detachably attached to a main body of the printer 101. The cassette 102 has a rear-end regulating plate 126 which is configured to regulate rear ends (upstream ends in a feeding direction) of the sheets S accommodated in the cassette 102. The rear-end regulating plate 126 is movable in the feeding direction and may be placed at a proper position based on the size (or length in the feeding direction) of sheets S so that the sheets S can be set at a proper position.

With the cassette 102 attached to the main body of the printer 101, a pickup roller 103 (feeding member) (hereinafter, called a pick roller 103) feeds a sheet S accommodated in the cassette 102. The sheet S fed by the pick roller 103 is conveyed to the further downstream side by a feed roller 106 (conveying member) and reaches a top sensor 108 through a registration roller pair 107. A separation roller 105 (separating member) and the feed roller 106 form a separation nip unit which is configured to prevent a plurality of (or two or more) sheets S from being fed to a downstream side of the separation nip unit. Operations of the separation roller 105 will be described in detail below. Thus, a sheet S positioned at the top in a perpendicular direction of the sheets S accommodated in the cassette 102 can only be fed to the registration roller pair 107.

A sheet S detected by the top sensor 108 (recording material detecting unit) is then conveyed to an image forming unit. The image forming unit includes a photosensitive drum 109, a charging roller 111, a laser scanner 113, a developing device 112, a transfer roller 110, and a fixing device 114. The photosensitive drum 109 is uniformly charged by the charging roller 111 and is then irradiated with laser light L by the laser scanner 113 so that an electrostatic latent image can be formed on its surface. The thus formed electrostatic latent image can be visualized as a toner image by using toner supplied to the developing device 112. The photosensitive drum 109 and the transfer roller 110 form a transfer nip unit, and a sheet S is conveyed to the transfer nip unit in synchronization with a rotation of the photosensitive drum 109. A toner image formed on the photosensitive drum 109 is transferred to the sheet S at the transfer nip unit. In order to transfer a toner image, voltage having an opposite polarity of that of the toner image is applied to the transfer roller 110. The sheet S to which the toner image has been transferred is conveyed to the fixing device 114 and is heated and is pressurized therein. As a result, the toner image transferred to the sheet S is fixed to the sheet S. The sheet S on which the toner image has been fixed is conveyed by a triple roller 116, an intermediate discharge roller 117, and a discharge roller 118 and is discharged to the sheet discharge tray 121. A series of printing operations ends up to this point.

In order to perform printing on both sides of a sheet S, the sheet S having one side printed is not discharged to the sheet discharge tray 121, but, after the rear end of the sheet S passes through the triple roller 116, the triple roller 116, the intermediate discharge roller 117, and the discharge roller 118 are reversely rotated. The sheet S is then conveyed to a both-surface convey path 125 and is further conveyed to the image forming unit again by a both-surface feeding roller 122. Thus, printing can be performed on both sides of the sheet S.

Referring to FIG. 1, a fixed sheet discharge sensor 115 and a both-surface conveyance sensor 123 are provided for judging whether the sheet S is normally being conveyed or not. A sheet presence detection sensor 104 is provided for detecting whether a sheet S is accommodated in the cassette 102 or not. The printer 101 has an operation panel 211 (hereinafter, called a panel 211) that is a display unit configured to display various kinds of information to a user.

Figure 2:
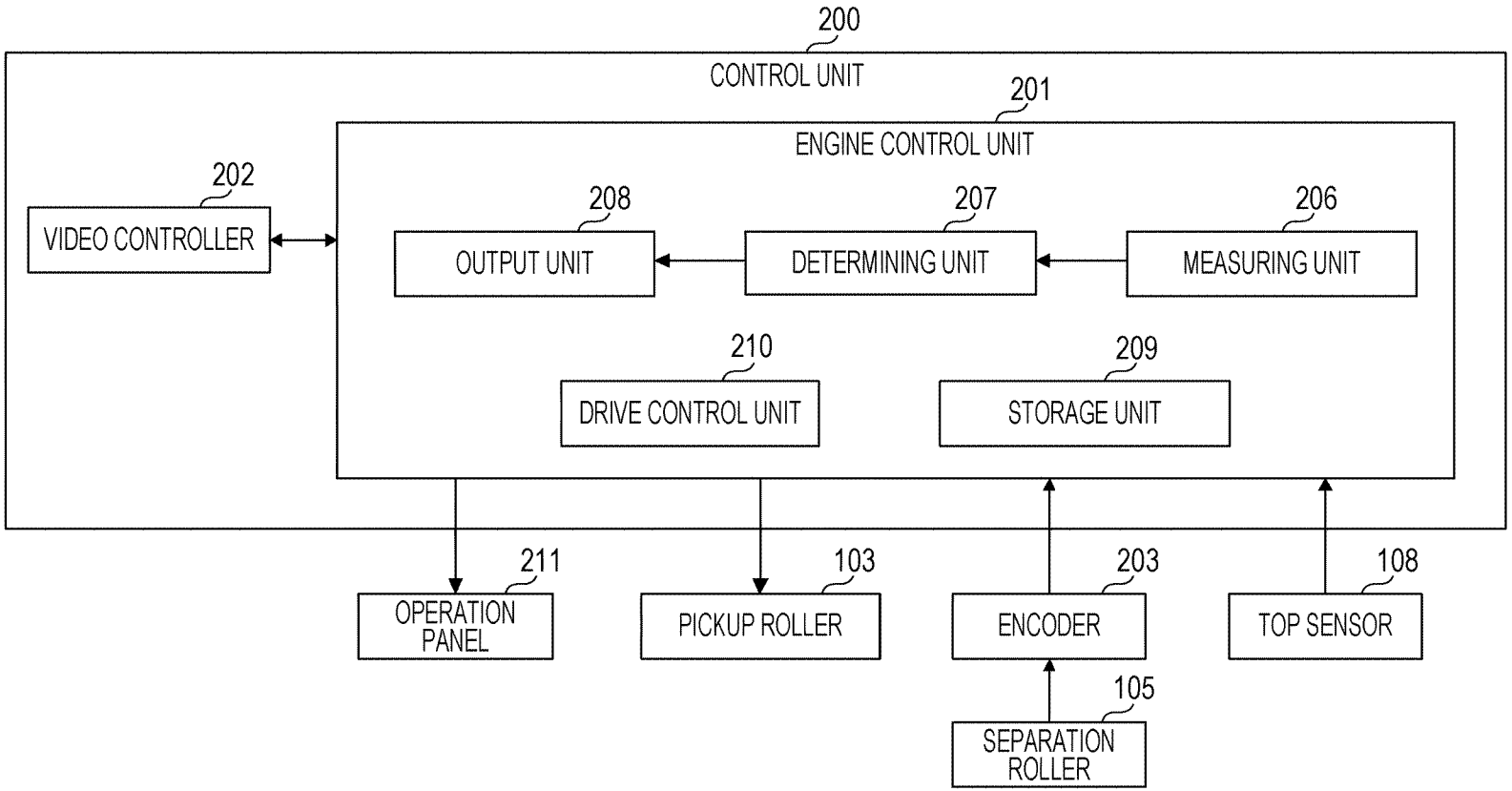
FIG. 2 is a control block diagram illustrating the image forming apparatus.

FIG. 2 is a block diagram illustrating a control unit 200 in the printer 101. The control unit 200 includes an engine control unit 201 and a video controller 202 which communicate with each other to execute the printing operation as described above. In response to a print instruction notified from an external apparatus (such as a PC), not illustrated, the video controller 202 analyzes image data, and the engine control unit 201 controls a mechanism of the printer 101 in accordance with a result of the analysis. The engine control unit 201 has a measuring unit 206, a judging unit 207, an output unit 208, a storage unit 209, and a drive control unit 210. The measuring unit 206 is configured to measure an elapsed time from start of feeding of a sheet S performed by the pick roller 103. The judging unit 207 is configured to judge whether the position of the rear-end regulating plate 126 is deviated from a proper position according to the size of sheets S or not based on the time period measured by the measuring unit 206. The output unit 208 is configured to, if the judging unit 207 judges that the position of the rear-end regulating plate 126 is deviated, notify the information to a user through the panel 211 or an external apparatus. The storage unit 209 is configured to store information regarding a print request notified from the video controller 202 and time periods measured by the measuring unit 206 in the past. The drive control unit 210 is configured to control boot and stop operations on a sheet feeding mechanism in accordance with detection results from sensors, which will be described below.

An encoder 203 (rotation detecting unit) and a top sensor 108 are connected to the engine control unit 201 and are configured to detect a rotation state of the separation roller 105. Detection results from these sensors are used by the drive control unit 210 for controlling driving of the pick roller 103. Here, the encoder 203 may be a code wheel provided coaxially with the separation roller 105, for example. Alternatively, an optical rotary encoder, a magnetic rotary encoder, or a photo-interrupter, for example, may be applied in accordance with the required accuracy and a location where it is placed. The panel 211 is further connected to the engine control unit 201 and is configured to receive information output from the output unit 208.

Description of Sheet Feeding Control

Next, a sheet feeding control over the printer 101 according to this embodiment will be described with reference to FIGS. 3A to 3D and FIG. 4.

Figure 3A:
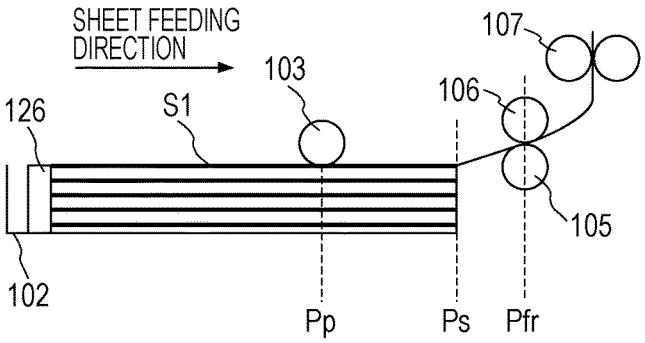
FIGS. 3A to 3D illustrate operations of a sheet feeding control.
Figure 4:
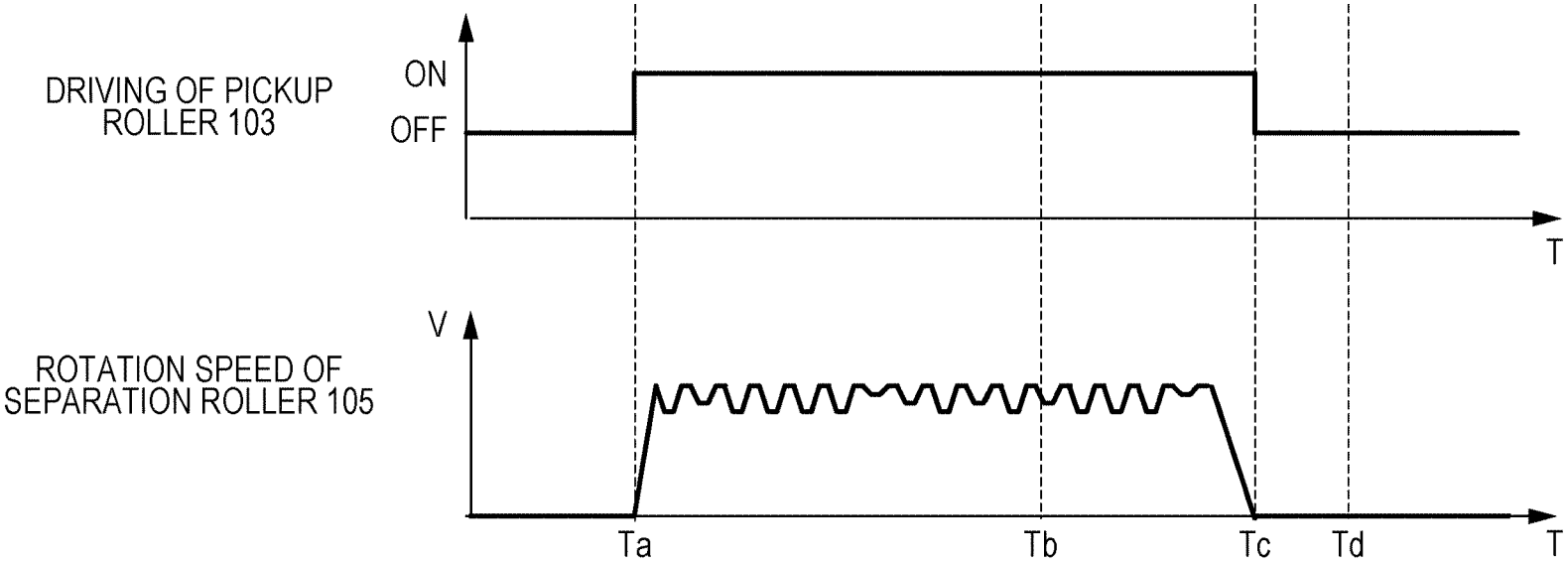
FIG. 4 is a timing chart when the sheet feeding control is executed.

FIG. 3A illustrates a sectional view of the cassette 102 at a time point when a sheet S1 positioned at the top of sheets accommodated in the cassette 102 is fed. When the sheet feeding control is started, the pick roller 103, the feed roller 106, and the separation roller 105 rotate, and the sheet S1 is fed to the right direction (sheet feeding direction) in FIG. 3A. FIG. 4 illustrates a graph having a horizontal axis indicating elapsed times and vertical axes indicating ON/OFF states of the driving of the pick roller 103 and rotation speeds V of the separation roller 105 where a time point Ta corresponds to the state illustrated in FIG. 3A. At the time point Ta, the driving of the pick roller 103 is shifted from an OFF state to an ON state so that the separation roller 105 starts rotating. Referring to FIG. 3A, Ps indicates a position of a leading end of a sheet S positioned by the rear-end regulating plate 126. The term "leading end" of a sheet S refers to an end on the downstream side in the sheet feeding direction of the sheet S. Pp indicates a position where the pick roller 103 nips the sheet S. Pfr indicates a position of a separation nip unit formed by the feed roller 106 and the separation roller 105.

The separation roller 105 is driven in a direction which prevents feeding of the sheet S (or a counterclockwise direction in FIG. 3A) and has a torque limiter, not illustrated. Here, when the feed roller 106 starts rotating in the direction that the sheet S is fed (or the counterclockwise direction in FIG. 3A), the separation roller 105 is operated by the torque limiter in the following manner. First, in a case where no sheet S is present at the separation nip unit, the separation roller 105 rotates in the direction that the sheet S is fed (clockwise direction in FIG. 3A) because of a setting that the force produced by friction with the feed roller 106 and received by the separation roller 105 is larger than a rotational load of the torque limiter. When one sheet S is conveyed to the separation nip unit, the separation roller 105 rotates in the direction that the sheet S is fed because of a setting that the force produced by friction produced with the one sheet S and received by the separation roller 105 and is larger than a rotational load of the torque limiter. On the other hand, the rotational load of the torque limiter is set to be greater than a force for conveying two or more sheets S to the separation nip unit. Thus, the separation roller 105 may stop because the conveyance force and the rotational load are equally matched or start rotating in the direction that the sheet feeding is prevented because of the larger rotational load of the torque limiter.

Figure 3B:
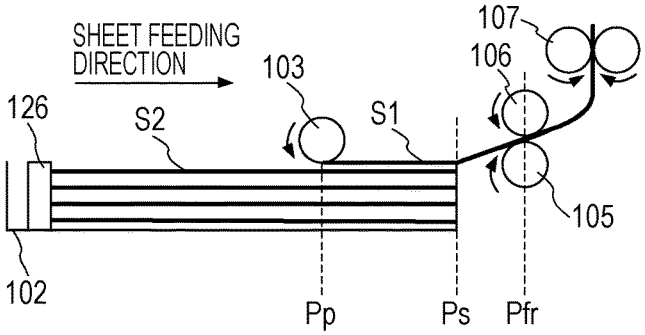

Next, FIG. 3B illustrates a sectional view of the cassette 102 at a time point when a rear end of the sheet S1 (an upstream end in the sheet feeding direction) reaches the position Pp of the nip of the pick roller 103. Because a sheet S2 positioned under the sheet S1 is to be fed with the sheet S1 above the sheet S2, the driving of the pick roller 103 is kept in an ON state. When the rear end of the sheet S1 passes through the pick roller 103, the pick roller 103 touches the sheet S2 and feeds the sheet S2 to the right direction. The graph in FIG. 4 illustrates a time point Tb corresponding to the state illustrated in FIG. 3B. At the time point Tb, the driving of the pick roller 103 keeps its ON state, and the separation roller 105 rotates by following the conveyed sheet S1.

Figure 3C:
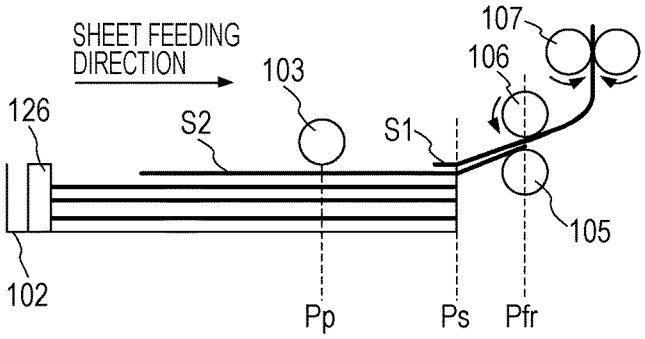

Next, FIG. 3C illustrates a sectional view of the cassette 102 at a time point when the leading end of the sheet S2 reaches the position Pfr of the separation nip unit formed by the feed roller 106 and the separation roller 105. The separation roller 105 as described above rotates in a clockwise direction when one sheet S is conveyed to feed the one sheet S. When two sheets S are conveyed, the separation roller 105 stops rotating or rotates in a counterclockwise direction and thus separates one sheet S from the two or more sheets S. In other words, the rotation state of the separation roller 105 changes. The graph in FIG. 4 illustrates a time point Tc corresponding to the state illustrated in FIG. 3C. Because the leading end of the sheet S2 reaches the position Pfr of the separation nip unit at the time point Tc, the separation roller 105 stops rotating. When the leading end of the sheet S2 reaches the position Pfr of the separation nip unit, the driving of the pick roller 103 is shifted from an ON state to an OFF to prevent the sheet S2 from being pushed into the separation nip unit and prevent paper jams. At that time, the driving of the feed roller 106 is also turned off, but the feed roller 106 is rotated by the sheet S1.

Figure 3D:
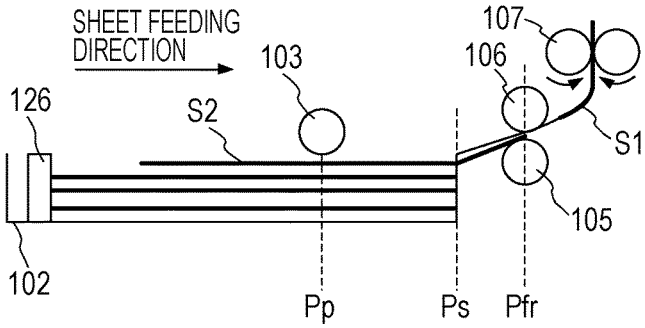

Next, FIG. 3D illustrates a sectional view of the cassette 102 at a time point when the rear end of the sheet S1 passes through the position Pfr of the separation nip unit formed by the feed roller 106 and the separation roller 105. The graph in FIG. 4 illustrates a time point Td corresponding to the state illustrated in FIG. 3D. Because the sheet S1 has passed through the position Pfr of the separation nip, the feed roller 106 stops rotating.

In the printer 101, if the leading end of the sheet S2 reaches the position Pfr of the separation nip unit and the separation roller 105 stops rotating or rotates in an opposite direction, as described above, the driving of the pick roller 103 is turned off. Because the sheet S1 and the sheet S2 are fed in advance with the sheet S2 placed over the sheet S1, the position of the leading end of the sheet S2 can be matched with the separation nip unit. This can reduce the distance (also called a sheet interval) between the rear end of the sheet S1 and the leading end of the sheet S2 for continuously performing the sheet feeding operation. In other words, the number of sheets to be printed per unit time period and the productivity of the printer 101 can be increased.

Detection of Deviation of Rear-End Regulating Plate

Next, with reference to FIGS. 5A and 5B, there will be described states of a sheet S accommodated in the cassette 102 in a case where the rear-end regulating plate 126 is placed at a proper position according to the size of sheets S and in a case where it is placed at a position deviated in a direction opposite against a sheet feeding direction about the proper position.

Figure 5A:
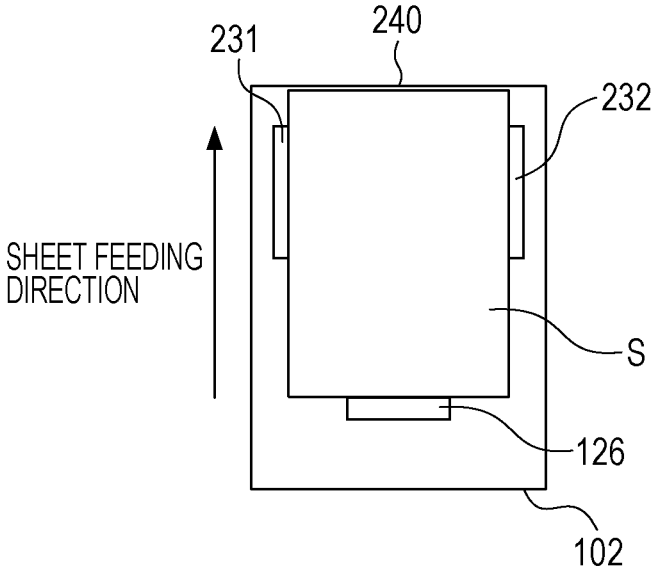
FIGS. 5A and 5B are plan views of a cassette in a case where a rear-end regulating plate is positionally deviated.

FIG. 5A is a plan view of the cassette 102 in a case where the rear-end regulating plate 126 is placed at a proper position according to the size of sheets S. When the rear-end regulating plate 126 is placed at a proper position, a sheet S is accommodated within the cassette 102 at a proper position without a deviation. In other words, the rear end of the sheet S in contact with the rear-end regulating plate 126 is regulated so that the leading end of the sheet S can be substantially matched with a leading-end regulating unit 240 of the cassette 102. Referring to FIG. 5A, side regulating plates 231 and 232 regulate a sheet S in a direction (width direction) orthogonal to the sheet feeding direction for sheets S.

Figure 5B:
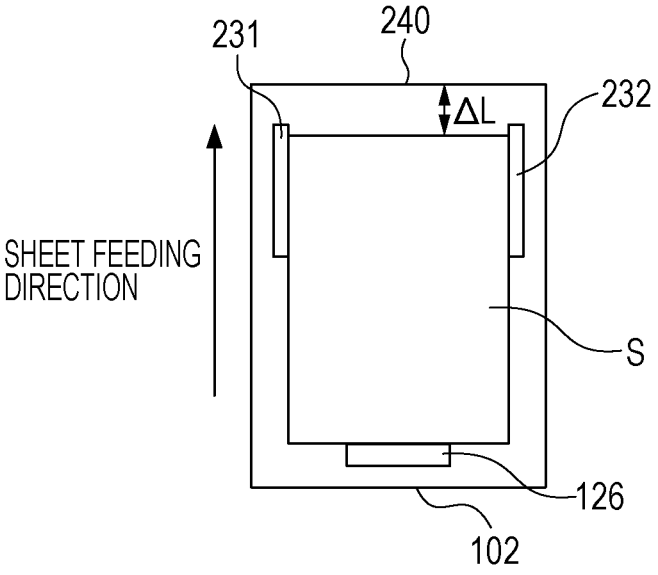

FIG. 5B is a plan view of the cassette 102 in a case where the rear-end regulating plate 126 is placed at a position deviated by ΔL toward the upstream side in the sheet feeding direction about the proper position. When the position of the rear-end regulating plate 126 is deviated, there is a high possibility that the position of a sheet S is deviated. Referring to FIG. 5B, because a sheet S is accommodated such that the rear end of the sheet S can be in contact with the rear-end regulating plate 126, the position of the sheet S is deviated by ΔL toward the upstream side in the sheet feeding direction.

Figure 6:
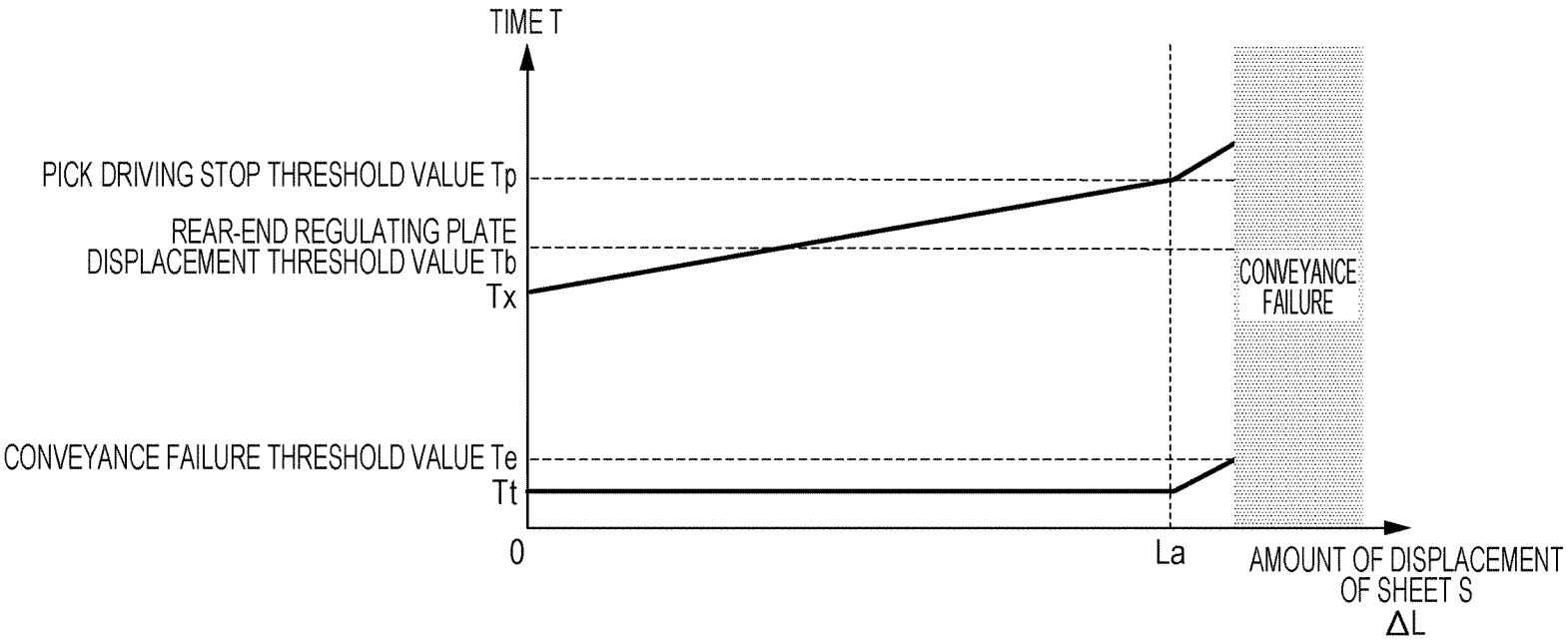
FIG. 6 is a graph illustrating a relationship between an amount of sheet deviation and a measured sheet feeding time.

Next, with reference to FIG. 6, a specific method for detecting a deviation of the rear-end regulating plate 126 will be described. FIG. 6 illustrates a graph having a horizontal axis indicating a deviation amount ΔL (a deviation amount toward the upstream side in the sheet feeding direction) of a sheet S accommodated in the cassette 102 and has a vertical axis indicating elapsed times from start of a sheet feeding operation. Referring to FIG. 6, Tt indicates a time period from start of a sheet feeding operation to detection of a leading end of a sheet S performed by the top sensor 108, and Tx indicates a time period from start of a sheet feeding operation to detection of a change in rotation state of the separation roller 105. Here, at a starting time of a sheet feeding operation, the pick roller 103 and the feed roller 106 start rotating, and the separation roller 105 is rotated by the rotation of the feed roller 106.

First, a case will be described where a deviation amount ΔL of a sheet S<La. According to this embodiment, as described above with reference to FIGS. 3A to 3D and FIG. 4, a control is executed which adjusts the leading end of a sheet S to be fed next to be matched with the position Pfr of the separation nip. Thus, the time period Tt to reach of the sheet S to the position of the top sensor 108 does not change even when the position of the rear-end regulating plate 126 is deviated. Therefore, it is difficult to detect the deviation of the rear-end regulating plate 126 based on the time period Tt. According to this embodiment, a time period Tx to detection of a change in rotation state of the separation roller 105 is applied. As illustrated in FIG. 6, the time period Tx increases as the amount of deviation of the position of the sheet S toward the upstream side in the sheet feeding direction. If the measured time period Tx is longer than the threshold time Tb for detection of a deviation of the rear-end regulating plate 126, it may be considered that there is a high possibility that the position of the sheet S is deviated due to a deviated position of the rear-end regulating plate 126.

Next, a case will be described where the deviation amount ΔL of a sheet S>La. According to this embodiment, if it is detected that the rotation state of the separation roller 105 changes during a period after a predetermined time passed from start of a sheet feeding operation on a sheet S, the driving of the pick roller 103 is turned off. Referring to FIG. 6, the predetermined time corresponds to a threshold time Tp for stopping the pick driving. In other words, if the deviation amount ΔL of a sheet S is excessively large, the sheet feeding operation is stopped before the leading end of the sheet S reaches the position Pfr of the separation nip. In this case, for the next sheet feeding, the time period depending on the distance from the leading end position of the sheet S to the position Pfr of the separation nip is added to the time period Tt and the time period Tx. As illustrated in FIG. 6, the rates of change of the time period Tt and the time period Tx increase from a time when the deviation amount of the sheet S exceeds La.

Here, if the measured time period Tt is longer than a threshold time Te for a conveyance failure, the engine control unit 201 judges that a conveyance failure such as a delayed print error has occurred. Therefore, the sheet feeding operation ends. Here, the threshold time Te is predefined for judging that a toner image formed on the photosensitive drum 109 cannot be transferred to a proper position of the sheet S.

If it is judged that the measured time period Tt is longer than the threshold time Te and that a conveyance failure has occurred, it is difficult to determine whether the conveyance failure is caused by a deviation of the rear-end regulating plate 126 or by another factor such as the lifetime of the pick roller 103. Therefore, according to this embodiment, data from which the conveyance failure is judged are not used for judging a deviation of the rear-end regulating plate 126 by the judging unit 207 in the engine control unit 201. However, the data may be used for detecting a deviation of the rear-end regulating plate 126.

A method for detecting a deviation of the rear-end regulating plate 126 according to this embodiment will be described with reference to flowchart in FIGS. 7A and 7B. Controls based on the flowchart in FIGS. 7A and 7B are executed by the engine control unit 201 installed in the control unit 200 based on a program stored in the storage unit 209 such as a ROM.

Figure 7A:
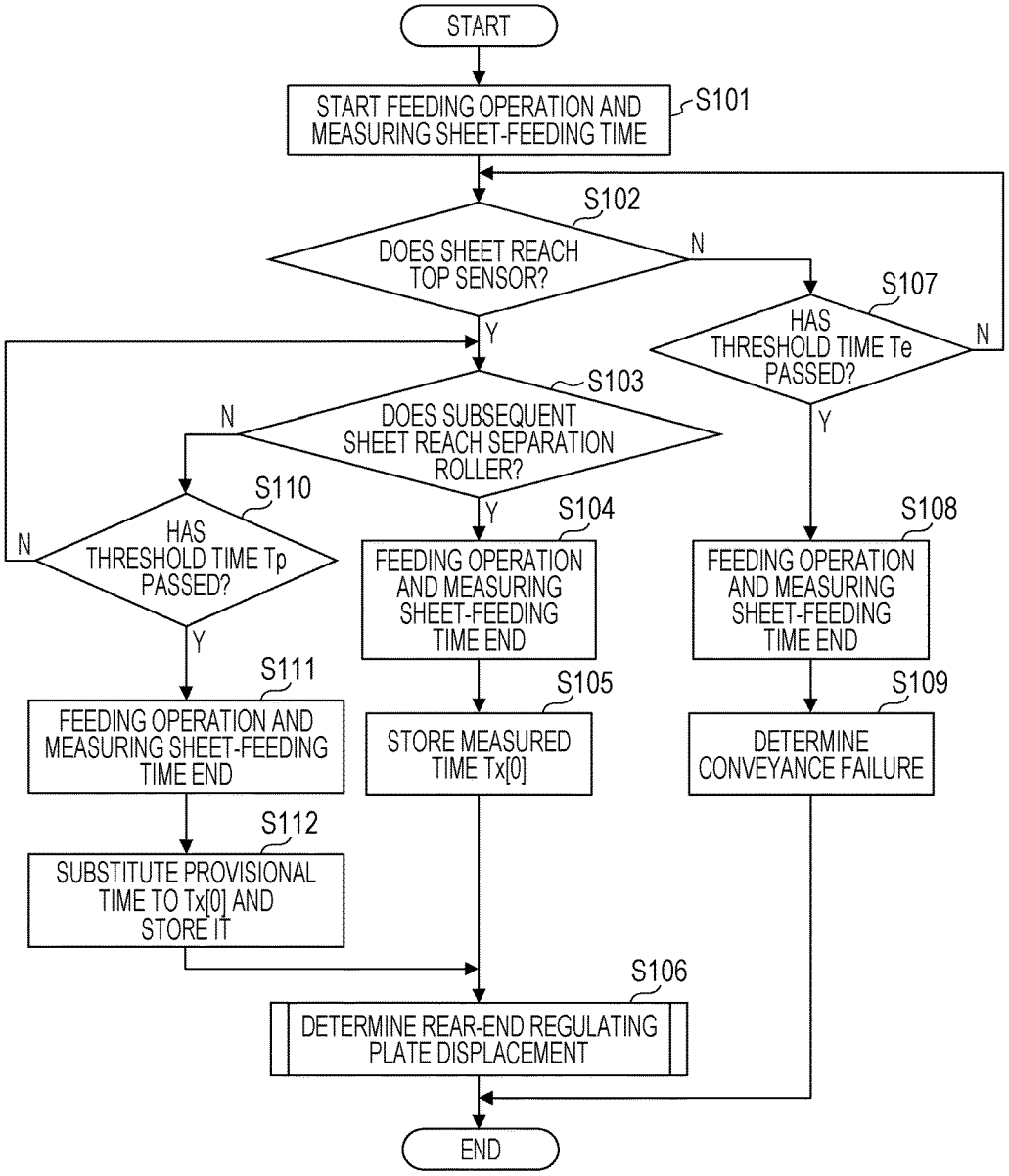
FIGS. 7A and 7B are flowcharts for detection of a deviation of the rear-end regulating plate.
Figure 7B:
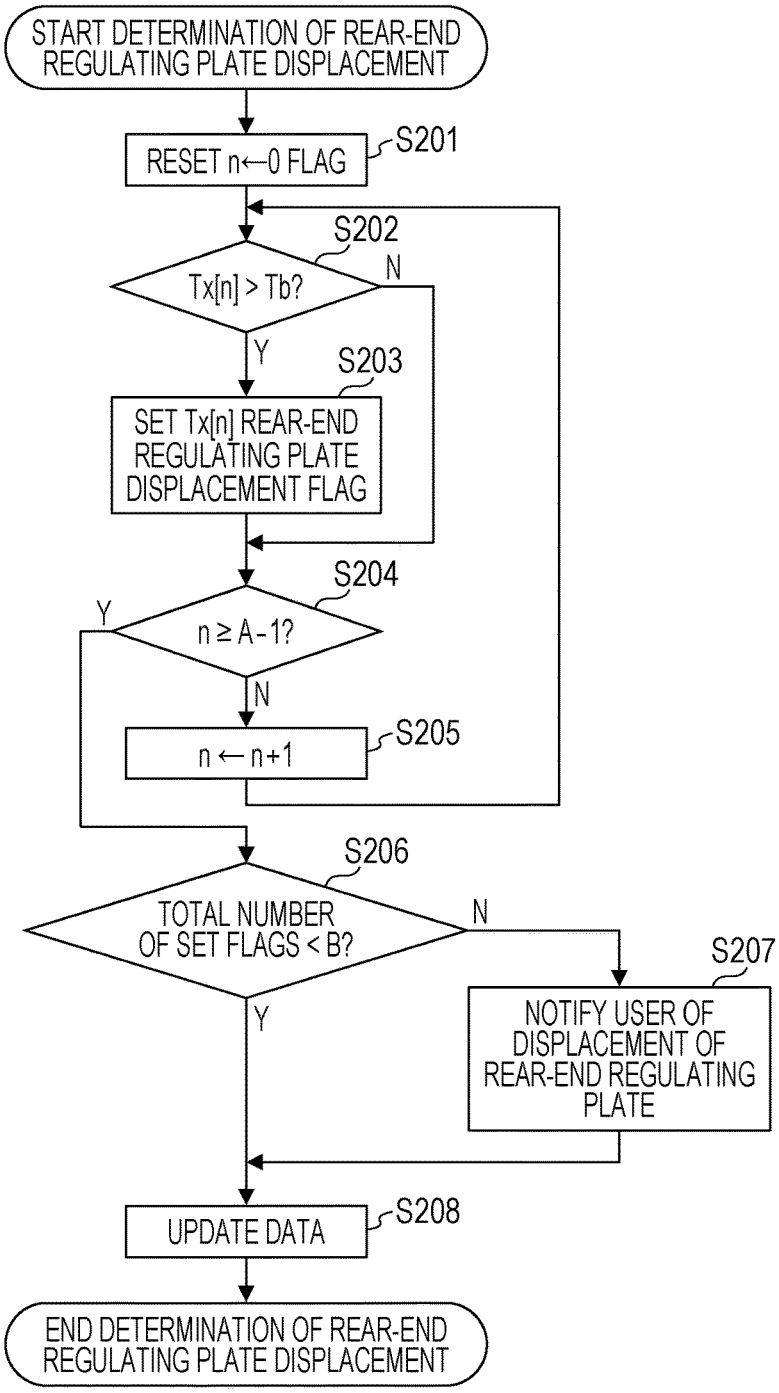

First, referring to FIG. 7A, the engine control unit 201 transmits an instruction to start sheet feeding to the drive control unit 210 and causes a sheet feeding operation to be started. At the same time, the measuring unit 206 starts measuring a sheet feeding time (S101). Next, the engine control unit 201 determines whether the top sensor 108 detects a sheet S or not (S102). If a sheet S is detected, the engine control unit 201 uses the encoder 203 to detect whether the leading end of a subsequent sheet S has reached the position Pfr of the separation nip (S103). In other words, whether the rotation state of the separation roller 105 has changed or not is detected. If it is detected that the leading end of the sheet S has reached the position Pfr of the separation nip, the engine control unit 201 uses the drive control unit 210 to stop the sheet feeding operation and finishes the measurement of the sheet feeding time performed by the measuring unit 206 (S104). The engine control unit 201 then stores a time period Tx[0] measured by the measuring unit 206 in the storage unit 209 (S105). The judging unit 207 judges whether the position of the rear-end regulating plate 126 is deviated or not based on the time period measured by the measuring unit 206 (S106) A subroutine in S106 will be described in detail.

On the other hand, if the top sensor 108 does not detect a sheet S in S102, the engine control unit 201 judges whether the sheet feeding time that is being counted by the measuring unit 206 is longer than the threshold time Te for a conveyance failure or not (S107). If it is not longer than the threshold time Te, the engine control unit 201 uses the drive control unit 210 to continue the sheet feeding operation. If it is longer than the threshold time Te, the engine control unit 201 uses the drive control unit 210 to stop the sheet feeding operation and finishes the measurement of the sheet feeding time performed by the measuring unit 206 (S108). The engine control unit 201 may then judge that a conveyance failure is caused by a delayed print error, for example, and notifies that the conveyance failure has occurred to a user through the panel 211 or an external apparatus (S109).

If it is judged in S103 that the leading end of the subsequent sheet S has not reached the position Pfr of the separation nip, the engine control unit 201 judges whether the sheet feeding time that is being counted by the measuring unit 206 is longer than the threshold time Tp for stopping the pick driving (5110). If it is not longer than the threshold time Tp, the engine control unit 201 uses the drive control unit 210 to continue the sheet feeding operation. If it is longer than the threshold time Tp, the engine control unit 201 uses the drive control unit 210 to stop the sheet feeding operation and finishes the measurement of the sheet feeding time performed by the measuring unit 206 (S111). According to this embodiment, data generated in a case where a sheet S is deviated by a larger deviation amount and the leading end of the sheet S has not reached the position Pfr of the separation nip during the threshold time Tp can be used for detecting a deviation of the rear-end regulating plate 126. Thus, the engine control unit 201 substitutes a provisional value to Tx[0] and stores it in the storage unit 209 (S112). It is assumed here that the provisional value is higher than a deviation threshold time Tb for the rear-end regulating plate 126. The judging unit 207 judges whether the position of the rear-end regulating plate 126 is deviated or not (S106).

Next, with reference to FIG. 7B, a subroutine in S106 will be described. First, the engine control unit 201 substitutes 0 to a variable n to reset a deviation flag of the rear-end regulating plate 126 (S201). The engine control unit 201 judges whether the time period Tx[n] stored in the storage unit 209 is longer than the deviation threshold time Tb for the rear-end regulating plate 126 or not (S202). If Tx[n] is longer than the threshold time Tb, the engine control unit 201 sets a flag corresponding to the variable n (S203). If Tx[n] is shorter than the threshold time Tb, the engine control unit 201 advances the processing to S204 without setting the flag corresponding to the variable n. The engine control unit 201 repeats this processing an equal number of times to the number A of sheets fed in the past (S204, S205).

If the number of check operations equal to the number A of sheets fed in the past are performed, the engine control unit 201 checks whether the total number of set flags is lower than a threshold number B of times or not (S206). If the total number of set flags is higher than the threshold number B of times, the judging unit 207 judges that the position of the rear-end regulating plate 126 is deviated. The output unit 208 notifies information indicating the fact to a user through the panel 211 or an external apparatus (S207). On the other hand, if the total number of set flags is lower than the threshold number B of times, the judging unit 207 judges that the position of the rear-end regulating plate 126 is deviated. The processing then moves to S208. According to this embodiment, in a case where it is defined that A=4 and B=3 and if the number of times that the time period Tx[n] during the past four sheet feeding operations is equal to or higher than the threshold time Tb is equal to or higher than three, it is judged that the position of the rear-end regulating plate 126 is deviated. The engine control unit 201 updates the lastly acquired data (S208). In other words, data at Tx[n] is updated by data at Tx[n+1], and the past sheet feeding data are updated thereby. The detection of a deviation of the rear-end regulating plate 126 completes up to this point.

Here, as the size (length in the sheet feeding direction) of a sheet S increases, the time period Tx measured by the measuring unit 206 increases. This is because the time period from feeding of a sheet S1 at the top in the cassette to passage of the rear end of the sheet S1 through the position Pfr of the separation nip increases as the size of the sheets S increases. For that, a plurality of threshold times Tb may be preset in consideration of the size of sheets S or other characteristics of sheets S, and the threshold time Tb to be applied may be changed in accordance with information regarding the sheets S acquired for performing a printing job.

For improved reliability of information to be notified, it is judged that the position of the rear-end regulating plate 126 is deviated if four sheets S are continuously fed, and the time period Tx exceeds the threshold time Tb three times. In other words, this can prevent wrong detection of a deviation of the rear-end regulating plate 126 with making a distinction from a case where a sheet feeding operation delays unexpectedly due to a pick error or a slip caused by abrasion of the pick roller 103. However, it may be judged that the position of the rear-end regulating plate 126 is deviated if the time period Tx exceeds the threshold time Tb once.

This detection of a deviation of the rear-end regulating plate 126 is applied only if the leading end of a sheet S reaches the position Pfr of the separation nip in the previous sheet feeding operation, such as after a continuous sheet feeding operation is started and two sheets are fed. For that, a result of the measurement for the first sheet is not used for the detection of a deviation of the rear-end regulating plate 126.

According to this embodiment, the positions of the leading ends of the sheets S accommodated in the cassette 102 are adjusted to be uniform for improved productivity, and a deviation of the rear-end regulating plate 126 provided in the cassette 102 can be detected. Prompting a user to check the cassette 102 if it is detected that the position of the rear-end regulating plate is deviated can reduce the possibility that a conveyance failure such as a delayed print error will occur in future. When a conveyance failure actually occurs, a cause thereof is notified to a user so that re-occurrence of the conveyance failure can also be prevented for improved usability. Even without such notification to a user, in a case where a mechanism is provided which automatically corrects the position of the rear-end regulating plate 126 to a proper position, the correction mechanism may place the position of the rear-end regulating plate 126 to a proper position when it is judged that the position of the rear-end regulating plate 126 is not at the proper position.

Second Embodiment

A second embodiment will be described in detail. Substantial parts of descriptions thereof are the same as those of the first embodiment, and differences from the first embodiment will only be described.

Figure 8A:
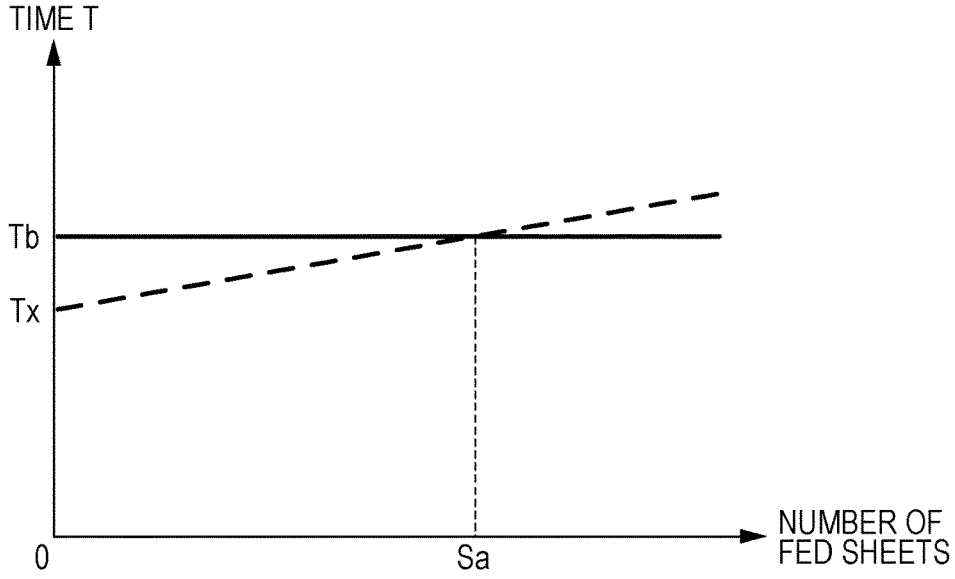
FIGS. 8A and 8B are graphs illustrating relationships between the number of fed sheets and a threshold time Tb according to a first embodiment and a second embodiment.

According to the first embodiment, a fixed threshold time Tb is set irrespective of the total number of sheets fed in the past from the cassette 102. FIG. 8A illustrates how it is set. FIG. 8A illustrates a broken line indicating a measured time period Tx and a solid line indicating the threshold time Tb. The time period Tx indicated by the broken line is a measured value in a state that the position of the rear-end regulating plate 126 is not deviated.

As the number of fed sheets increases, the time period Tx from start of feeding of a sheet S1 at the top in the cassette to reach of the leading end of the next sheet S2 to the position Pfr of the separation nip increases because of reduced performance of sheet feeding of the sheet feeding mechanism due to abrasion of rollers. Therefore, if the number of fed sheets is higher than Sa, the measured time period Tx is longer than the threshold time Tb even though the position of the rear-end regulating plate 126 is set at a proper position. As a result, there is a possibility that it is wrongly judged that the rear-end regulating plate 126 is not at a proper position. According to this embodiment, appropriate judgment can be performed.

Figure 8B:
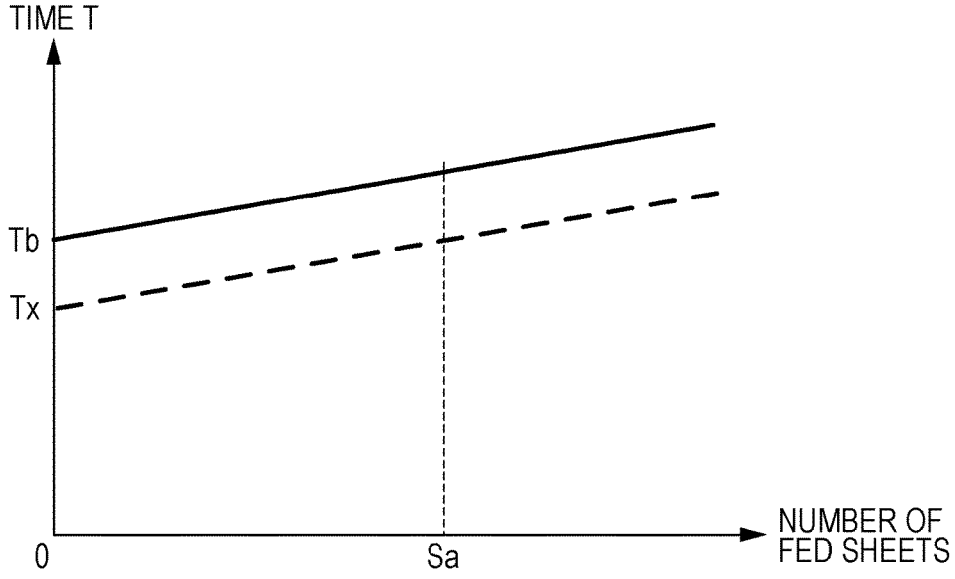

FIG. 8B illustrates a relationship between the number of fed sheets and the threshold time Tb according to this embodiment. This embodiment is characterized in that, as illustrated in FIG. 8B, the threshold time Tb is changed to a value according to the number of fed sheets. As the number of fed sheets increases, the time period Tx increases because of reduced performance of sheet feeding of the sheet feeding mechanism due to abrasion of rollers. Thus, the threshold time Tb is set longer in accordance with the number of fed sheets stored in the storage unit 209. Therefore, even when the time period Tx is increased, it can be prevented from exceeding the threshold time Tb if the rear-end regulating plate 126 is set at a proper position.

How much the threshold time Tb is increased in accordance with the number of fed sheets stored in the storage unit 209 may be set based on results of advance experimental verifications of the degree of increase of the time period Tx according to the number of fed sheets. The degree of deterioration of the sheet feeding performance may be calculated in consideration of parameters including not only the number of fed sheets but also a print mode, a sheet type and surrounding environment (temperature and humidity) to correct the threshold time Tb.

According to this embodiment, in addition to the effect acquired by the first embodiment, the following effect can be provided. That is, wrong detection of a deviation of the rear-end regulating plate 126 due to reduced sheet feeding performance can be prevented, and a deviation of the rear-end regulating plate 126 can be detected with high accuracy.

Variation Example

Figure 9:
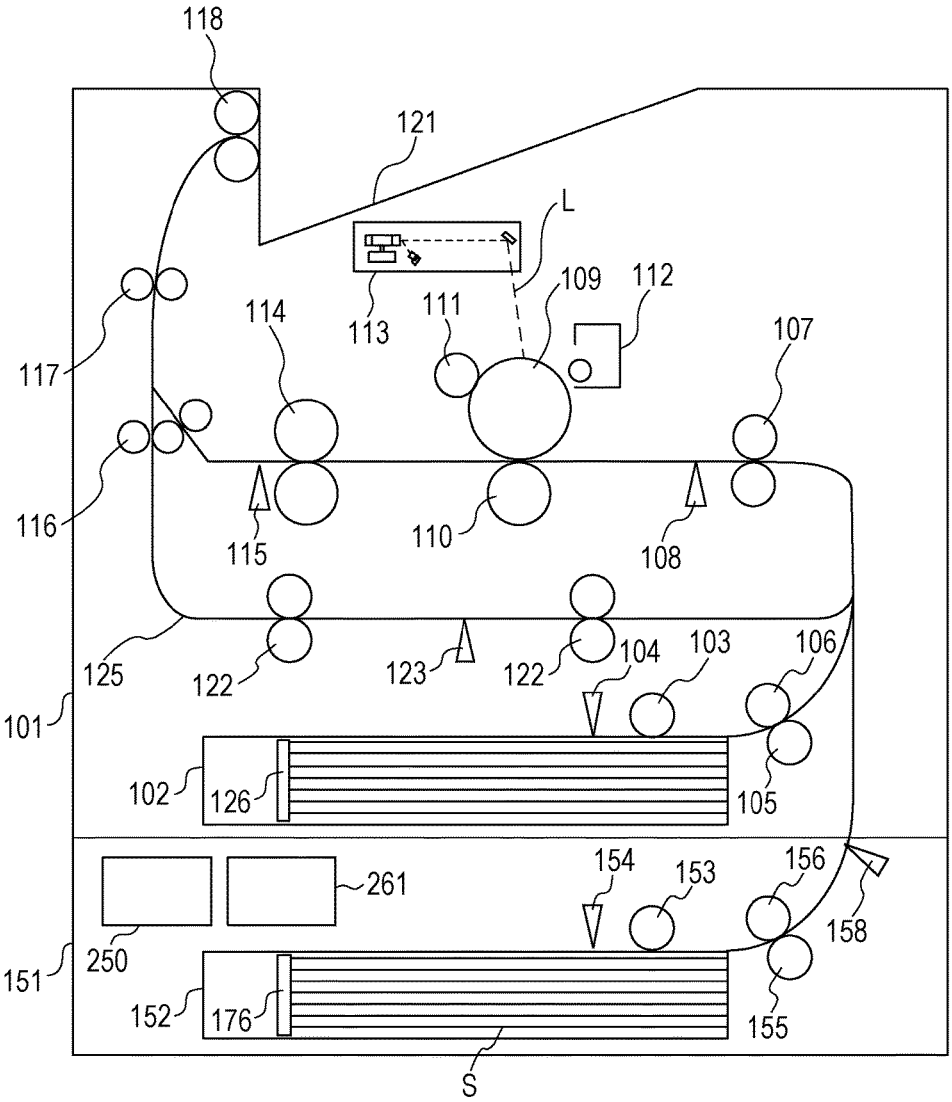
FIG. 9 is a schematic configuration diagram illustrating an image forming apparatus and a sheet feeding option according to a variation example.

According to the first and second embodiments, the control unit 200 is installed in the printer 101, for example. However, embodiments are not limited thereto. As illustrated in FIG. 9, an option control unit 250 may be installed in the sheet feeding option 151 detachably attached to the printer 101. The option control unit 250 may execute the aforementioned control.

The cassette 152 is an accommodation unit configured to accommodate a sheet S (recording material) and is detachably attached to a main body of the printer 101. The rear-end regulating plate 176 provided in the cassette 152 is configured to regulate a rear end (or an end on an upstream side in the feeding direction) of a sheet S accommodated in the cassette 152. The rear-end regulating plate 176 is movable in the feeding direction and is placed at a proper position according to the size (length in the feeding direction) of sheets S so that the sheets S can be set at a proper position.

With the cassette 152 attached to the main body of the sheet feeding option 151, a pickup roller 153 (hereinafter, called a pick roller 153) feeds a sheet S accommodated in the cassette 152. The sheet S fed by the pick roller 153 is fed to the further downstream side by a feed roller 156 and reaches the top sensor 108 through an option sensor 158 and the registration roller pair 107. A separation roller 155 and the feed roller 156 form a separation nip unit which is configured to prevent a plurality of sheets S from being fed to a downstream side of the separation nip unit. The separation roller 155 operates in the same manner as that of the separation roller 105. Thus, a sheet S positioned at the top in a perpendicular direction of sheets S accommodated in the cassette 152 can only be fed to the registration roller pair 107. The sheet feeding option 151 has an operation panel 261 (hereinafter, called a panel 261) which is configured to display various kinds of information to a user.

Figure 10:
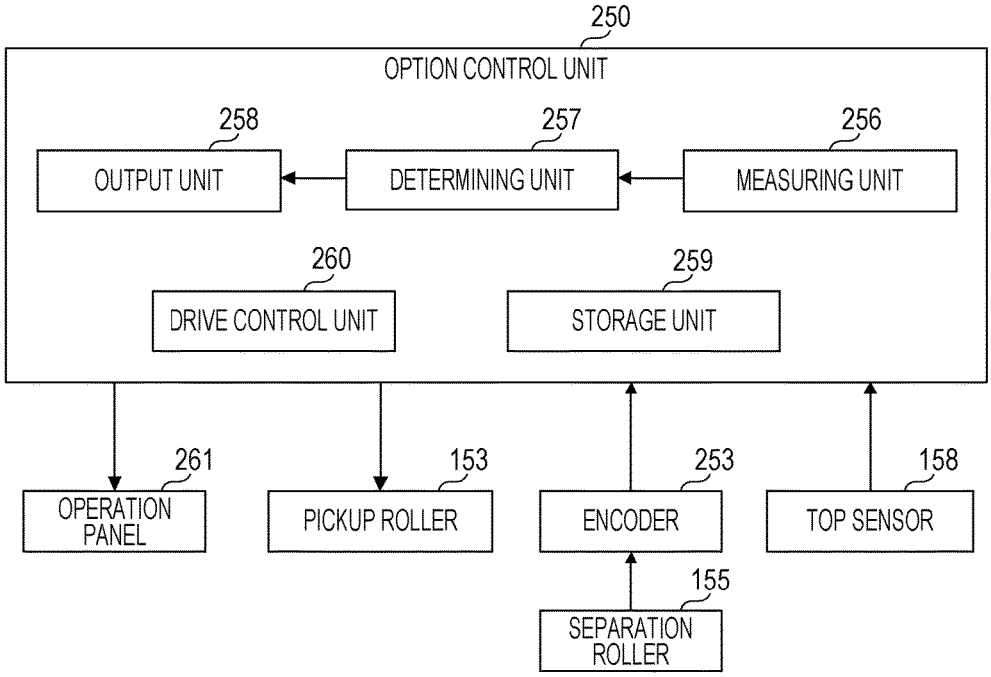
FIG. 10 is a control block diagram illustrating a sheet feeding option according to the variation example.

FIG. 10 is a control block diagram of the option control unit 250. The option control unit 250 has a measuring unit 256, a judging unit 257, an output unit 258, a storage unit 259, and a drive control unit 260. An encoder 253 and the option sensor 158 are connected to the option control unit 250 and are configured to detect a rotation state of the separation roller 155. Detection results from these sensors are used by the drive control unit 260 for controlling driving of the pick roller 153. According to a variation example, the top sensor 108 according to the aforementioned embodiments may be replaced by the option sensor 158 to execute the same controls.

According to the first and second embodiments, the cassette 102 detachably attached to the printer 101 is applied as an accommodation unit, for example. However, embodiments are not limited thereto. The accommodation unit may be a manual feed tray or a multi-tray capable of inserting a sheet S into the printer 101. With a rear-end regulating plate provided in such an accommodation unit, a deviation thereof can be detected in the same manner.

According to the first and second embodiments, the driving of the pick roller 103 is turned off to control so as to prevent the pick roller 103 from executing a sheet feeding operation. However, embodiments are not limited thereto. For example, the pick roller 103 may be configured to move between a contact position where it touches a sheet S and a retracted position where it does not touch the sheet S. In this configuration, the pick roller 103 is moved from the contact position to the retracted position at a time when the leading end of the sheet S2 reaches the separation roller 105 to control the pick roller 103 so as not to execute the sheet feeding operation. In other words, the pick roller 103 is isolated from the sheet S. In this case, the driving of the pick roller 103 may be kept in an ON state, that is, the pick roller 103 may be kept rotating.

According to the first and second embodiments, it is judged that the sheet S2 reaches the separation roller 105 at a time when the encoder 203 detects that the separation roller 105 stops rotating or rotates in an opposite direction. However, embodiments are not limited thereto. At a time when it is detected that the rotation speed in a forward direction of the separation roller 105 is lower than a predetermined rotation speed, the reach of the sheet S2 to the separation roller 105 may be judged. The forward direction here is a direction in which a sheet S is to be fed. Thus, the driving of the pick roller 103 can be turned off earlier under the second sheet feeding control to control such that the pick roller 103 can be prevented from excessively pushing the leading end of the sheet S2 toward the separation nip unit Pfr.

According to the first and second embodiments, the reach of the sheet S2 to the separation roller 105 is judged based on a detection result of a rotation state of the separation roller 105. However, embodiments are not limited thereto. For the judgment, a double-feed detection sensor configured to detect a double feed of sheets S may be provided in neighborhood of the separation roller 105. Here, the double-feed detection sensor may be an ultrasonic sensor or a transmitted light detection sensor.

While the disclosure has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-055761 filed Mar. 18, 2016, which is hereby incorporated by reference herein in its entirety.

What is claimed is:

1. An image forming apparatus comprising:

an accommodation unit configured to accommodate a recording material;

a feeding member configured to feed a recording material accommodated in the accommodation unit;

a conveying member configured to convey a recording material fed by the feeding member;

a separating member configured to form a nip with the conveying member and separate a plurality of recording materials at the nip;

a detecting unit configured to detect that the plurality of recording materials has been fed to the nip;

a control unit which causes the feeding member to start feeding of a recording material accommodated in the accommodation unit and, in a case where the detecting unit detects that a plurality of recording materials is fed to the nip, causes the feeding member to finish the feeding;

an image forming unit configured to form an image on a recording material fed from the accommodation unit; and a regulating unit configured to regulate an end on an upstream side in a feeding direction of recording materials accommodated in the accommodation unit, wherein the control unit measures a time period from start of feeding of a recording material performed by the feeding member to detection by the detecting unit of that a plurality of recording materials is fed to the nip and, based on the measured time period, outputs information indicating that a position of the regulating unit is deviated from a position according to a size of the recording materials accommodated in the accommodation unit.

2. The image forming apparatus according to claim 1, wherein the control unit counts the number of times that the measured time period exceeds a first threshold time, and, in a case where the counted number of times is higher than a predetermined threshold number of times, outputs the information indicating that the position of the regulating unit is deviated, or, in a case where the counted number of times is lower than the predetermined threshold number of times, does not output the information indicating that the position of the regulating unit is deviated.

3. The image forming apparatus according to claim 2, further comprising a recording material detecting unit configured to detect whether a recording material has reached a position on a downstream side in a recording-material feeding direction of the nip, wherein, in a case where the recording material detecting unit does not detect a recording material during a period after a second threshold time shorter than the first threshold time from start of feeding of a recording material performed by the feeding member, the control unit causes the feeding member to finish the feeding.

4. The image forming apparatus according to claim 2, wherein, in a case where the detecting unit does not detect that a plurality of recording materials is fed to the nip in a period after a third threshold time longer than the first threshold time from start of feeding of a recording material performed by the feeding member, the control unit causes the feeding member to finish the feeding.

5. The image forming apparatus according to claim 2, wherein the first threshold time is set based on a size of recording materials accommodated in the accommodation unit, a number of recording materials fed from the accommodation unit, or an ambient temperature or humidity.

6. The image forming apparatus according to claim 1, wherein, in a case where a plurality of recording materials is to be fed continuously from the accommodation unit and where a leading end of a first recording material to be fed is not fed to the nip, the control unit does not use the time period measured for the first recording material for judging that the position of the regulating unit is deviated.

7. The image forming apparatus according to claim 1, further comprising a display unit configured to display the information indicating that the position of the regulating unit is deviated.

8. The image forming apparatus according to claim 1, wherein the regulating unit is movable in the feeding direction, and wherein the information is information indicating that the position of the regulating unit is deviated in a direction opposite against the feeding direction from a position according to the size of the recording materials.

9. The image forming apparatus according to claim 1, wherein, to finish the feeding operation by the feeding member, the control unit stops rotation of the feeding member or separates the feeding member and a recording material in the accommodation unit.

10. The image forming apparatus according to claim 1, wherein, when one recording material is fed to the nip, the separating member is rotated by the one recording material in a predetermined direction, and, when a plurality of recording materials is fed to the nip, the separating member stops rotating or rotates in a direction opposite to the predetermined direction to feed one recording material of the plurality of recording materials and prevent the remaining recording materials from being fed, wherein the detecting unit is a rotation detecting unit configured to detect a rotation state of the separating member, and wherein it is detected that the plurality of recording materials is fed to the nip in a case where the rotation detecting unit detects the a rotation speed in the predetermined direction of the separating member is lower than a predetermined speed and that the separating member stops rotating or rotates in the opposite direction.

11. A feeding device comprising:

an accommodation unit configured to accommodate a recording material;

a feeding member configured to feed a recording material accommodated in the accommodation unit;

a conveying member configured to convey a recording material fed by the feeding member;

a separating member configured to form a nip with the conveying member and separate a plurality of recording materials at the nip;

a detecting unit configured to detect that the plurality of recording materials has been fed to the nip;

a control unit which causes the feeding member to start feeding of a recording material accommodated in the accommodation unit and, in a case where the detecting unit detects that a plurality of recording materials is fed to the nip, causes the feeding member to finish the feeding; and a regulating unit configured to regulate an end on an upstream side in a feeding direction of recording materials accommodated in the accommodation unit, wherein the control unit measures a time period from start of feeding of a recording material performed by the feeding member to detection by the detecting unit of that a plurality of recording materials is fed to the nip and, based on the measured time period, outputs information indicating that a position of the regulating unit is deviated from a position according to a size of the recording materials accommodated in the accommodation unit.

12. The feeding device according to claim 11, wherein the control unit counts the number of times that the measured time period exceeds a first threshold time, and, in a case where the counted number of times is higher than a predetermined threshold number of times, outputs the information indicating that the position of the regulating unit is deviated, or, in a case where the counted number of times is lower than the predetermined threshold number of times, does not output the information indicating that the position of the regulating unit is deviated.

13. The feeding device according to claim 11, wherein the regulating unit is movable in the feeding direction, and wherein the information is information indicating that the position of the regulating unit is deviated in a direction opposite against the feeding direction from a position according to the size of the recording materials.

14. The feeding device according to claim 11, wherein, to finish the feeding operation by the feeding member, the control unit stops rotation of the feeding member or separates the feeding member and a recording material in the accommodation unit.

15. The feeding device according to claim 11, wherein, when one recording material is fed to the nip, the separating member is rotated by the one recording material in a predetermined direction, and, when a plurality of recording materials is fed to the nip, the separating member stops rotating or rotates in a direction opposite to the predetermined direction to feed one recording material of the plurality of recording materials and prevent the remaining recording materials from being fed, wherein the detecting unit is a rotation detecting unit configured to detect a rotation state of the separating member, and wherein it is detected that the plurality of recording materials is fed to the nip in a case where the rotation detecting unit detects the a rotation speed in the predetermined direction of the separating member is lower than a predetermined speed and that the separating member stops rotating or rotates in the opposite direction.

* * * * *